US005398401A

United States Patent [19]

Knight

[11] Patent Number: 5,398,401

[45] Date of Patent: Mar. 21, 1995

[54] METHOD FOR MANUFACTURING AN ELECTRICAL SWITCHING CONTACTOR

[75] Inventor: Michael W. Knight, Fuquay-Varina, N.C.

[73] Assignee: Square D Company, Palatine, Ill.

[21] Appl. No.: 144,111

[22] Filed: Oct. 27, 1993

[51] Int. Cl.[6] ..... H01F 41/06

[52] U.S. Cl. ..... 29/605; 29/416; 29/609

[58] Field of Search ..... 29/605, 609, 602.1, 29/622, 416; 335/147

[56] References Cited

U.S. PATENT DOCUMENTS 4,603,314 7/1986 Fukunaga et al. ..... 29/605 X
5,160,820 11/1992 Tsujii et al. ..... 29/605 X

*Primary Examiner*—Carl E. Hall
*Attorney, Agent, or Firm*—Larry I. Golden; David R. Stacey

[57] ABSTRACT

A method for manufacturing an electrical switching contactor provides a more effective electro-magnetic pulling force in a smaller sized package. The method includes forming at least two adjacent closed-loop laminated metal cores from a substantially continuous length of magnetic metal, providing a coil bobbin separated into first and second sections through a vertical axis, arranging the first and second sections about a center portion of the closed-loop laminated cores, such that the center potion includes a part of each adjacent closed-loop. A coil is wrapped around the coil bobbin, and the coil bobbin is arranged with respect to the coil to electrically insulate the coil from the adjacent closed-loop laminated cores. The laminated cores are separated into an open-loop "E"-shaped motor section having a center leg with the coil-wound coil bobbin mounted thereon and an armature section having a set of contact surfaces for mating with contact surfaces on the motor section in response to an electro-magnetic force drawing the armature and motor sections together.

15 Claims, 4 Drawing Sheets

METHOD FOR MANUFACTURING AN ELECTRICAL SWITCHING CONTACTOR

FIELD OF THE INVENTION

The present invention generally relates to current interruption devices and, more particularly, electrical switching contactors arranged to interrupt current flow between a power source and a load.

BACKGROUND OF THE INVENTION

A conventional electrical switching contactor includes an "E"-shaped iron motor section, a motor coil on a spool having a center mounted over the middle leg of the motor section, and an armature shaped with three contact surfaces which mate with the ends of the three legs of the "E"-shaped iron motor section. The armature is movably supported with respect to the motor section so that, in response to a current being applied to the motor coil, an electro-magnetic field can draw, against a biasing separation force, the armature into contact with the motor section. By mounting one or more contacts on the armature and arranging a corresponding set of fixed contacts in proper relationship to the armature-mounted contacts, the control current applied to the motor coil is used in response to power applied to switch "on" or "off" electrical loads in series with contacts.

Known contactors have been manufactured by individually laminating or stamping out iron cores for the respective "E"-shaped motor section and armature. The coil-spool combination is separately assembled and subsequently placed over the center leg of the "E"-shaped motor section. While slight improvements have been made from time to time to increase the efficiencies and strengths associated with the electro-magnetic force which pulls the armature toward the motor section in the above method of manufacture, the magnitude of the electro-magnetic pulling force for a given application is largely dependent upon size of the laminated core and power applied to the coil. An application requiring a relatively small electromagnetic pulling force requires a relatively small contactor, and an application requiring a relatively large electro-magnetic pulling force requires a relatively large contactor.

The foregoing assembling technique suffers from several drawbacks. One drawback is that the foregoing assembly technique may lead to a loss of magnetic core permeability due to assembly interface air gaps, eddy currents, opposing material grain directions and stresses in the stamped core laminations. These deficiencies, in turn, produce relatively large variabilities. Another drawback is that core laminations in the assembly technique use an involved assembly process requiring the expensive and burdensome steps of stamping, orienting, stacking and fastening of the core laminations. Yet another drawback is that the assembly technique results in inefficient magnetic flux paths, thereby increasing the required size of the contactors. A further drawback is that the core lamination material used in the assembly technique is relatively thick because the laminations are stamped, oriented, stacked, riveted and in general handled as individual components. The thicker lamination material, in turn, increases eddy currents and bending stresses, resulting in a decrease in magnetic core permeability. Another drawback is that stamping methods used in the assembly technique produce a high percentage of scrap, which results in a waste of expensive iron core material. In addition, these stamping methods produce stresses in the iron material which degrade the permeability of the core.

A need therefore exists for a method for manufacturing an electrical switching contactor which overcomes the aforementioned drawbacks associated with existing manufacturing techniques.

SUMMARY OF THE INVENTION

In accordance with the foregoing, the present invention provides a method for manufacturing an electrical switching contactor which overcomes the aforementioned drawbacks associated with existing manufacturing techniques.

More specifically, the present invention provides an electrical switching contactor including a laminated core having no air gaps, and no opposing grain structure or rivets which impede electro-magnetic flux.

The present invention also provides processes for laminating the core using extremely thin (e.g., 0.001 inch) tape-shaped material, so as to reduce stresses and eddy currents when control current is applied to the contactor coil.

According to a preferred embodiment, the present invention provides a method for manufacturing an electrical switching contactor, comprising the steps of providing at least two adjacent closed-loop metal cores; mounting a first coil bobbin half and a second coil bobbin half around a center portion of the metal cores, the center portion including a part of each adjacent closed-loop; winding a coil around the mounted coil bobbin halves; and separating the metal cores into a first section including the coil-wound bobbin halves and a second mating section.

The above summary of the present invention is not intended to represent each embodiment, or every aspect, of the present invention. This is the purpose of the figures and the detailed description which follow.

BRIEF DESCRIPTION OF THE DRAWINGS

Other objects and advantages of the invention will become apparent upon reading the following detailed description and upon reference to the drawings in which.

While the invention is susceptible to various modifications and alternative forms, specific embodiments thereof have been exemplified by way of the drawings and will be described in detail. It should be understood, however, that it is not intended to limit the invention to the particular form described. On the contrary, the intention is to cover all modifications, equivalents and alternatives falling within the spirit and scope of the invention as defined by the appended claims.

DETAILED DESCRIPTION OF THE PREFERRED EMBODIMENT

Figures 1, 2:
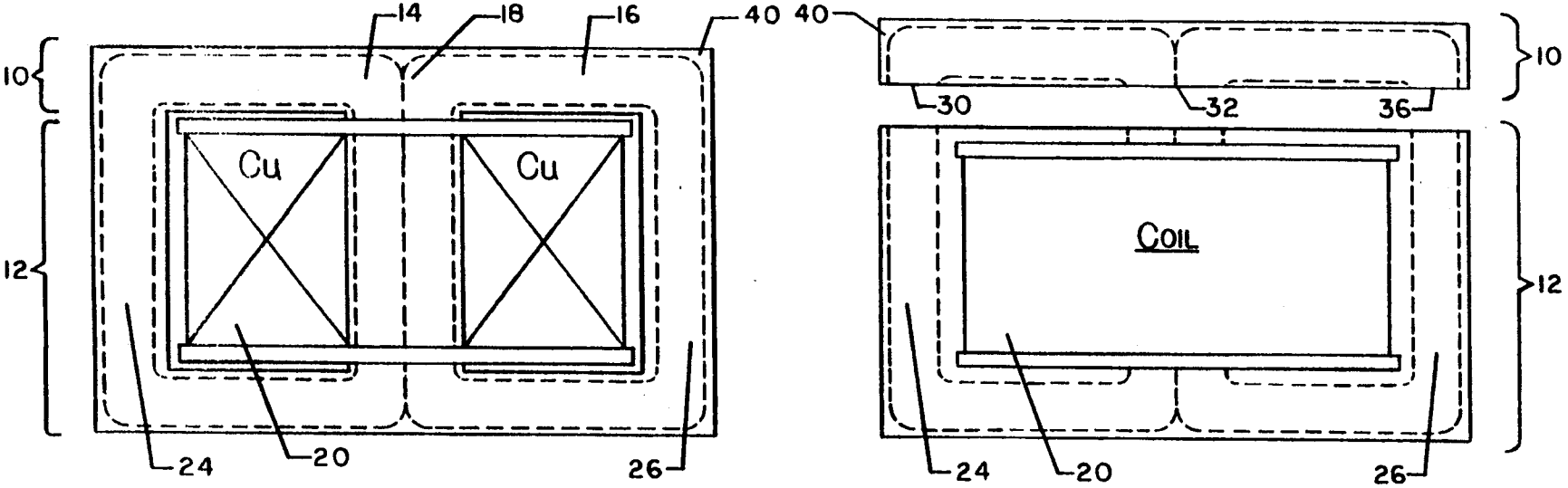
FIG. 1 is a side view of an electrical switching contactor partially manufactured in accordance with the principles of the present invention.
FIG. 2 is a side view of the electrical switching contactor of FIG. 1 after being manufactured in accordance with the principles of the present invention.

Turning now to the drawings, FIGS. 1 and 2 respectively illustrate an electrical switching contactor just before completing the step of separating the armature section 10 from the motor section 12 and just after this same step.

In FIG. 1, the contactor is shown including a pair of laminated (or stamped out) cores 14 and 16 (in dotted lines) with the armature and motor sections 10 and 12 as an integral part of the same cores 14 and 16. The cores 14 and 16 form a pair of adjacent closed-loop highly-permeable metal structures and, while virtually any shape of closed-loop structure is adequate, the cores 14 and 16 are preferably constructed and arranged so that they form a common center portion 18 about which a plastic-like insulating coil bobbin 20 is mounted.

The coil bobbin 20 includes a center section having a copper coil (or wire) wrapped tightly around the coil bobbin so that, in response to a control current applied to the exposed ends (not shown) of the coil, a significant electro-magnetic force is generated about the cores 14 and 16.

In FIG. 2, the line at which the armature section 10 is cut away (or otherwise removed) from the motor section 12 is shown to be above the top of the coil bobbin 20 and far enough down the outer vertical legs 24 and 26 and the center portion 18 so that the armature section 10 includes three pairs of mating surfaces for contact between the armature section 10 and the motor section 12. This separation line can also be staggered with the lines in the legs 24 and 26 below the line in the center portion 18.

In both FIGS. 1 and 2, the structure is shown being covered with an overmolded synthetic (e.g., durable plastic) material 40. The step of overmolding is preferably performed before the step of separating the armature section 10 from the motor section 12 to avoid having to handle two separate structures during the overmolding process.

Figure 4:
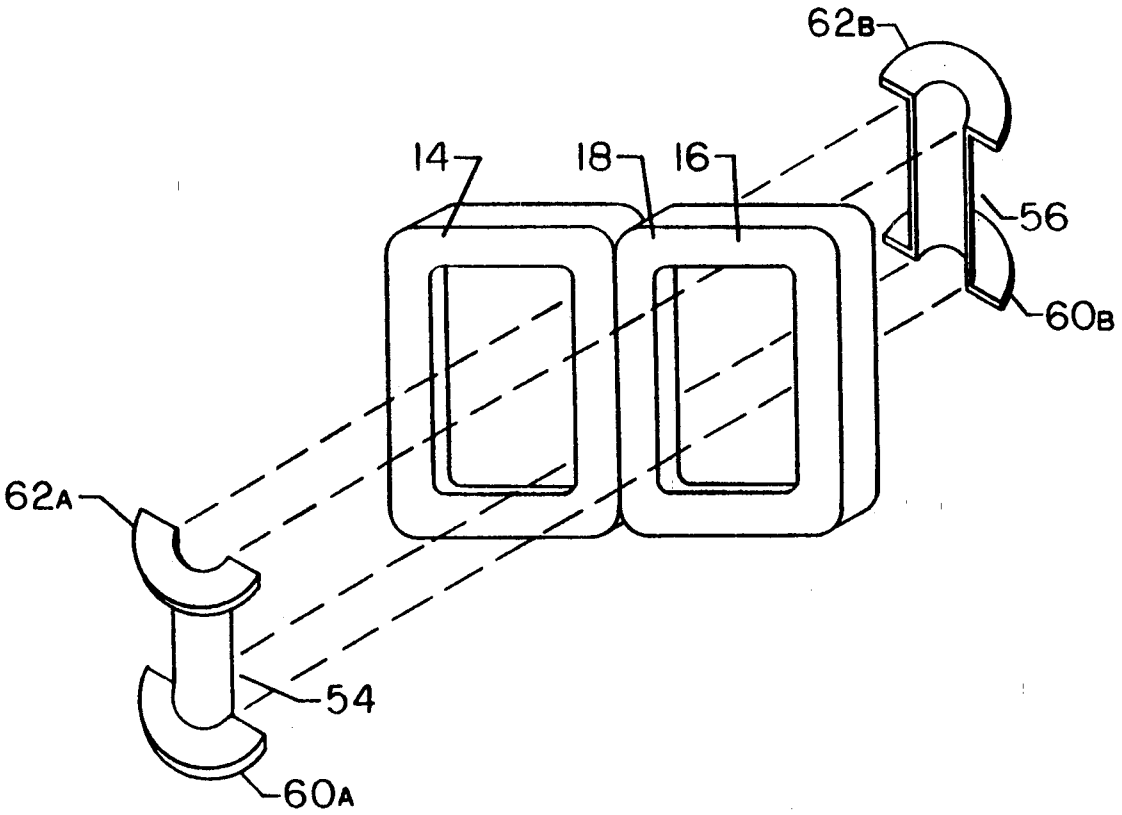
FIGS. 3–5 comprise various views of portions of the electrical switching contactor of FIG. 2 and illustrating a process, in accordance with the present invention; for manufacturing the electrical switching contactor of FIG. 2.
Figure 3:
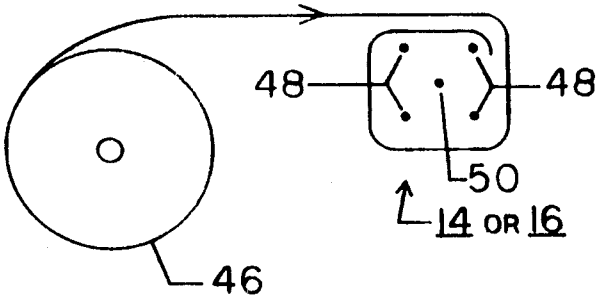
Figure 5:
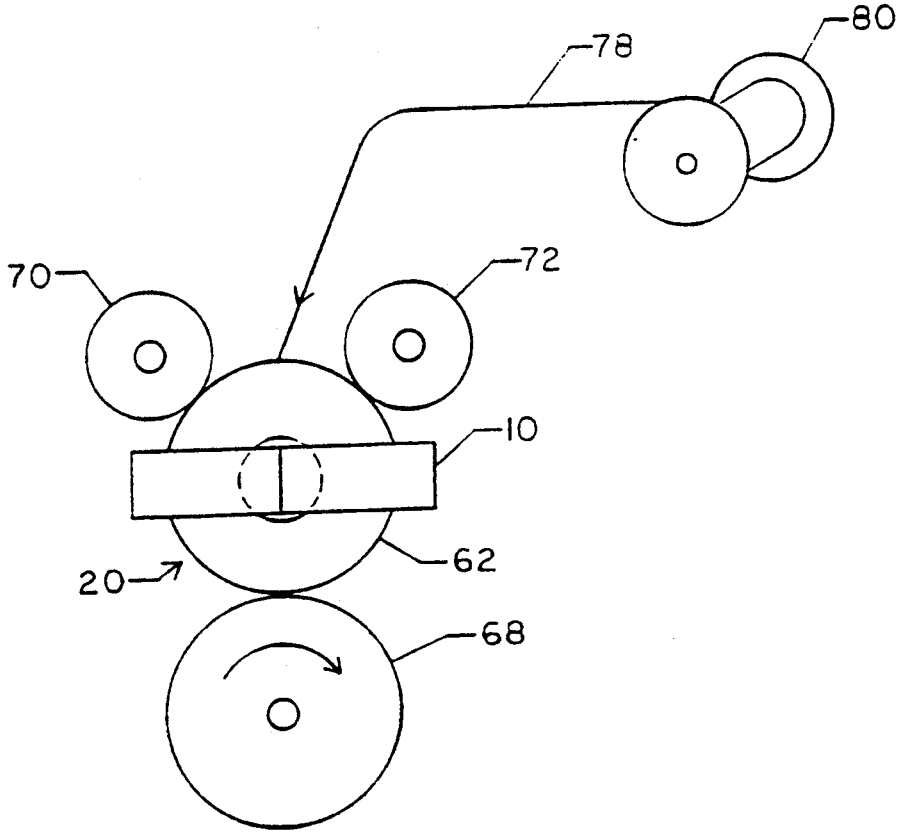

Referring now to FIGS. 3–5, a series of diagrams illustrate a preferred manner for manufacturing the electrical switching contactor of FIGS. 1 and 2.

FIG. 3 involves the step of manufacturing the cores 14 and 16 by lamination, rather than the alternative method of directly stamping out the cores 14 and 16 from iron scrap. Using a substantially continuous length of ferromagnetic material, in the form and shape of wire or thin (e.g., 0.001 inch) tape-shaped material, supplied via a reel 46, the cores 14 and 16 are formed by turning a set of four pins 48 about a center axis 50 so as to draw the length of iron from the reel 46 and cause it to be wrapped around itself. The lead end of the length of ferromagnetic material is attached to one of the pins and the set of pins 48 is turned until the core 14, 16 reaches the desired thickness.

There are a number of electromagnetic-related advantages to forming the cores 14, 16 in accordance with this process, including increased magnetic core permeability due to the elimination of interface air gaps, less power required to hold the armature when the coil is energized, and elimination of opposing material grain directions and stresses. For further details regarding this core lamination technique, reference may be made to U.S. patent application Ser. No. 08/114,110 entitled. "Method for Assembling a Current Transformer," in which a similar core lamination method is more fully described and illustrated, incorporated herein by reference.

Once the cores 14 and 16 are completely formed, they are held or attached adjacent one another so as to form the center portion 18 (FIGS. 1 and 2). At this point in the manufacturing process, the structure of the electrical switching contactor is in the form illustrated in FIG. 1, without the coil bobbin 20 and overmold layer 40 of synthetic protective material. Referring now to FIG. 4, the next step is to mount and secure the two halves 54 and 56 of the coil bobbin 20 about the center section 18. Use of the term "half" or "halves" is not intended to refer strictly to one-half of the overall material and/or circumference of a "whole" bobbin, but rather refers to two sections providing sufficient electrical protection to the coil wrapped around the bobbin. Shoulders **60*a*, 60*b*, 62*a* and 62*b* at the outer edges of the bobbin halves 54 and 56** preferably meet to form an insulating barrier through which the wrapped coil will not penetrate.

In FIG. 5, the shoulder 62 of the bobbin halves 54 and 56 is shown from a top perspective mounted around the center portion (18 of FIG. 4) and under the armature section (10 of FIGS. 1 and 2). A drive wheel 68 includes an outer surface for contacting and driving the flange portion of the mounted coil bobbin 20. Two holding wheels 70 and 72 are used to support the bobbin as the copper wire 78 is drawn from a reel 80 by the rotating force of the driving wheel 68, thus forming the coil around the bobbin.

Figure 6:
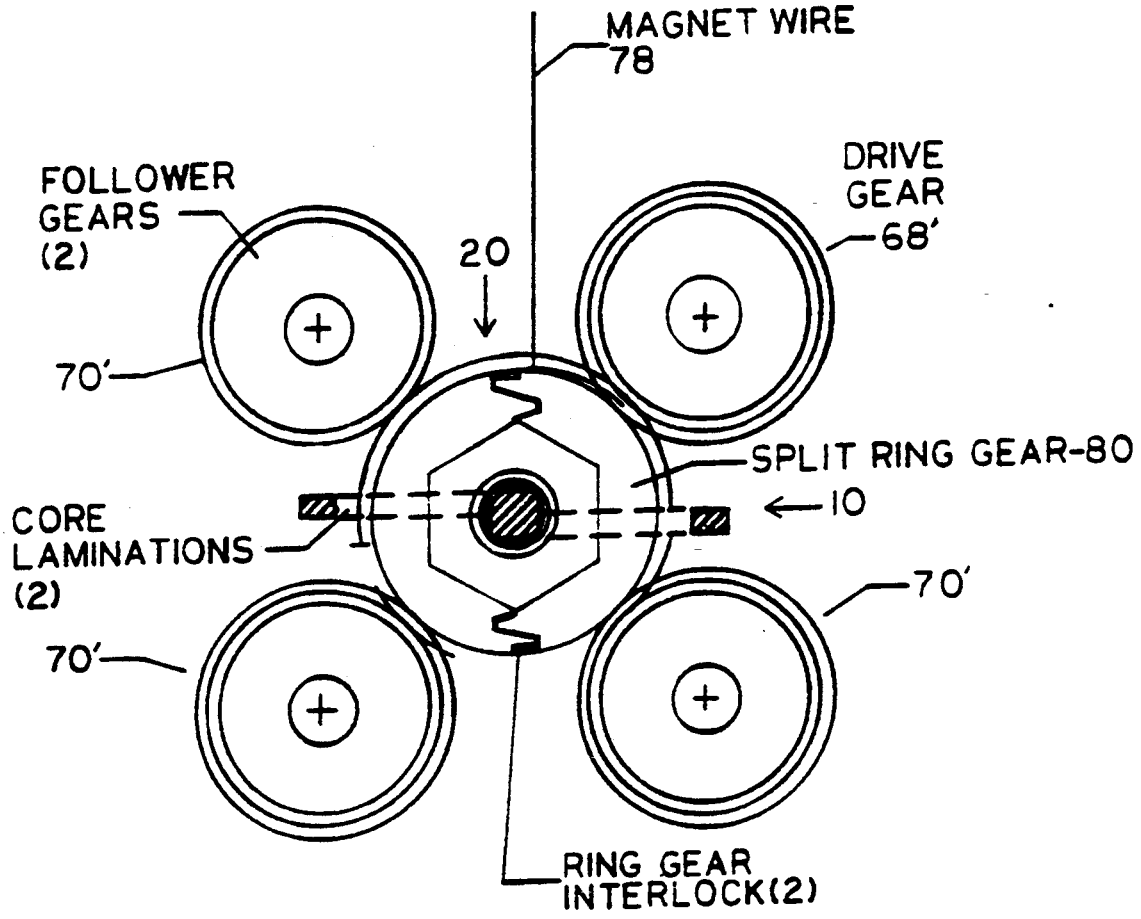
FIG. 6 illustrates an alternative step to the step shown by way of FIG. 5.

In the alternative and as shown in FIG. 6, a ring gear can be used to engage the bobbin flange. This mitigates wear and damage to the plastic bobbin and provides more control and winding speed.

After the copper wire 78 is wrapped around the bobbin 20 the specified number of times (to effect the desired magnetic flux), the copper wire 78 is cut and the two ends (not shown) of the coil are terminated for reception of the control current, e.g., a trip command signal as set forth in U.S. patent application Ser. No. 08/143,948, entitled "Self-Powered Circuit Interruption Arrangement ", incorporated herein by reference in its entirety.

Referring now to FIG. 1, the electrical contactor assembly consisting of the cores 14 and 16 with bobbin 20 and the coil around the center portion 18 is overmolded with a layer of suitable synthetic protective material 40. The armature section 10 is then separated from the motor section 12 as described in connection with FIG. 2. It may be desirable to overmold only the cores 14 and 16 in which case the overmolding process is done prior to assembling the bobbin halves 54 and 56 about the center portion 18.

While the present invention has been described with reference to one or more particular embodiments, those skilled in the art will recognize that many changes may be made thereto without departing from the spirit and scope of the present invention, which is set forth in the following claims.

I claim:

1. A method for manufacturing an electrical switching contactor, comprising:

providing at least two adjacent closed-loop metal cores;

mounting a first coil bobbin half and a second coil bobbin half around a center portion of the metal cores, the center portion including a part of each adjacent closed-loop;

winding a coil around the mounted coil bobbin halves; and separating the metal cores into a first section including the coil-wound bobbin halves and a second mating section.

2. A method for manufacturing an electrical switching contactor, according to claim 1, wherein the step of winding includes spin-winding the coil by rotating the mounted coil bobbin halves.

3. A method for manufacturing an electrical switching contactor, according to claim 1, wherein the metal cores are laminated from a substantially continuous length of metal.

4. A method for manufacturing an electrical switching contactor, according to claim 3, wherein the length of metal is tape-shaped.

5. A method for manufacturing an electrical switching contactor, according to claim 3, wherein the length of metal is wire-shaped.

6. A method for manufacturing an electrical switching contactor, according to claim 1, wherein the metal cores are stamped out.

7. A method for manufacturing an electrical switching contactor, comprising:

forming at least two adjacent closed-loop laminated metal cores from a substantially continuous length of magnetic metal;

providing a coil bobbin separated into first and second sections through a vertical axis;

arranging the first and second sections about a center portion of the closed-loop laminated cores, the center portion including a part of each adjacent closed-loop;

winding a coil around the coil bobbin, the coil bobbin arranged with respect to the coil to electrically insulate the coil from the adjacent closed-loop laminated cores;

separating the laminated cores into an open-loop "E"-shaped motor section having a center leg with the coil-wound coil bobbin mounted thereon and an armature section having a set of contact surfaces for mating with contact surfaces on the motor section in response to an electro-magnetic force drawing the armature and motor sections togethers.

8. A method for manufacturing an electrical switching contactor, according to claim 7, further including the step of overmolding a synthetic material around at least a portion of the laminated cores.

9. A method for manufacturing an electrical switching contactor, according to claim 8, wherein the step of overmolding is performed after the step of winding and before the step of separating.

10. A method for manufacturing an electrical switching contactor, according to claim 8, wherein the step of overmolding is performed after the step of separating.

11. A method for manufacturing an electrical switching contactor, according to claim 7, wherein the coil bobbin includes at least one coil-containing shoulder.

12. A method for manufacturing an electrical switching contactor, according to claim 7, wherein the step of forming includes using tape-shaped metal for the substantially continuous length of magnetic metal.

13. A method for manufacturing an electrical switching contactor, according to claim 7, wherein the step of forming includes the step of using wire-shaped metal for the substantially continuous length of magnetic metal.

14. A method for manufacturing an electrical switching contactor, according to claim 7, wherein the step of winding includes spin-winding the coil by rotating the coil bobbin to draw the coil.

15. A method for manufacturing an electrical switching contactor, according to claim 7, wherein the step of providing the coil bobbin further includes the step of separating the coil bobbin into the first and second halves.

* * * * *